United States Patent [19]

Sharpless et al.

[11] Patent Number: 4,784,331

[45] Date of Patent: Nov. 15, 1988

[54] ELECTROSTATIC SPRAY GUN DEVICE AND CABLE ASSEMBLY

[75] Inventors: John Sharpless, Oberlin; John C. A. Traylor, Elyria; Ronald J. Hartle; Thomas E. Hollstein, both of Amherst, all of Ohio

[73] Assignee: Nordson Corporation, Amherst, Ohio

[21] Appl. No.: 54,746

[22] Filed: May 27, 1987

[51] Int. Cl.[4] ..... B05B 5/04

[52] U.S. Cl. ..... 239/698; 239/707; 118/626

[58] Field of Search ..... 239/691, 706, 707, 697, 239/698, 704, 690, 705, 708, 3; 118/626; 361/226, 227, 228; 55/107

[56] References Cited

U.S. PATENT DOCUMENTS

| | | | |
|---|---|---|---|
| 2,926,106 | 2/1960 | Gauthier | 118/626 |
| 3,065,106 | 11/1962 | Rhodes et al. . | |
| 3,317,138 | 5/1967 | Fraser . | |
| 3,448,925 | 6/1969 | Cross . | |
| 3,521,815 | 7/1970 | Szasz . | |
| 3,599,038 | 8/1971 | Skidmore . | |
| 3,608,823 | 9/1971 | Buschor . | |
| 3,667,674 | 6/1972 | Parsons et al. . | |
| 3,746,254 | 7/1973 | Duncan et al. . | |
| 3,819,115 | 6/1974 | Soderman . | |
| 3,844,486 | 10/1974 | Roberson . | |
| 4,103,276 | 7/1978 | Kennon et al. . | |
| 4,169,560 | 10/1979 | Vohringer . | |
| 4,182,490 | 1/1980 | Kennon . | |
| 4,216,915 | 8/1980 | Hengartner et al. . | |
| 4,235,381 | 11/1980 | Vila . | |
| 4,277,197 | 7/1981 | Bingham . | |
| 4,335,851 | 6/1982 | Hastings . | |
| 4,380,320 | 4/1983 | Hollstein et al. . | |
| 4,534,106 | 8/1985 | Simashkevich et al. | 239/691 |
| 4,543,710 | 10/1985 | Hastings et al. | 239/691 |
| 4,548,363 | 10/1985 | McDonough . | |
| 4,576,827 | 3/1986 | Hastings et al. | 239/706 |
| 4,634,058 | 1/1987 | Hollstein et al. | 239/697 |

FOREIGN PATENT DOCUMENTS

| | | |
|---|---|---|
| 1954813 | 6/1971 | Fed. Rep. of Germany . |
| 2811125 | 9/1979 | Fed. Rep. of Germany . |
| 7113656 | 4/1973 | Netherlands . |
| 0952357 | 8/1982 | U.S.S.R. . |
| 1236664 | 6/1971 | United Kingdom . |
| 1241593 | 8/1971 | United Kingdom . |
| 1406358 | 9/1975 | United Kingdom . |
| 1554851 | 10/1979 | United Kingdom . |

*Primary Examiner*—Andres Kashnikow
*Assistant Examiner*—Chris Trainor
*Attorney, Agent, or Firm*—Wood, Herron & Evans

[57] ABSTRACT

An electrostatic spray device and cable assembly for charging coating material applied to an article in industrial finishing operations includes a gun body having a powder flow passageway and a dielectric sleeve contained within the passageway such that the discharge opening of the spray device surrounds the sleeve. The cable assembly comprises a dielectric tube having a hollow interior and a high voltage electrostatic cable mounted within the tube and connected at one end to a supply of electrostatic voltage. A particle deflector having an electrode in the form of a resistive sheet is mounted by the tube in charging relationship to a coating particle discharge opening in the spray gun, and the opposed end of the cable is electrically connected to the electrode. An adjustment device acts on the tube and cable to move them as a unit within the passageway in the spray gun to adjust the axial position of the deflector and electrode relative to the particle discharge opening in the spray device.

5 Claims, 2 Drawing Sheets

ELECTROSTATIC SPRAY GUN DEVICE AND CABLE ASSEMBLY

BACKGROUND OF THE INVENTION

This invention relates to electrostatic spray devices having one or more high voltage electrodes for charging coating material to be sprayed upon an object, and, more particularly, to an electrostatic spray gun adapted to receive a cable assembly which adjustably mounts a combined electrode and particle deflector in the path of coating particles discharged from the spray gun to control the spray pattern and electrostatic charge applied to the coating particles while minimizing shock and ignition hazard due to inadvertent discharge of electrical energy capacitively stored in the gun.

In industrial finishing applications, coating particles are emitted from a spray device such as a spray gun toward an object to be coated. One type of coating material is in the form of particulate powder entrained in a stream of air. One or more electrodes associated with the spray gun impart an electrostatic charge to the coating particles as they are emitted toward an object to be coated. The object to be coated is maintained at an electrostatic potential different than that of the charged coating particles so that the coating particles are attracted to the article and deposited thereon with improved efficiency and coverage.

The spray gun is connected to a high voltage electrostatic supply which provides electrostatic potentials of approximately 30 KV or more to the charging electrode. The high voltage electrostatic supply may be remotely located with respect to the spray gun, in which event an electrical cable insulated for high voltage is connected between the spray gun and the remote source. A device of this type for electrostatically spraying particulate powder material is shown, for example, in U.S. Pat. No. 3,746,254 to Duncan et al.

In electrostatic spray coating systems, electrical energy is capacitively stored in the electrical path which supplied charging potential to the electrode. Included in this charge conducting path are components of the high voltage electrostatic supply, interconnecting high voltage cables, electrical switches, contacts, conductors and the like. Additionally, electrical energy is capacitively stored in the spray gun itself as a consequence of the presence of structural elements of an electrically conductive nature which function in much the same manner as plates of a capacitor. Should the capacitively stored energy be rapidly discharged, such as where the elecrode is inadvertently electrically grounded or brought in close proximity to an electrically grounded object, a spark can result having sufficient energy to cause ignition of combustible concentrations of coating powder which are often present in the environment surrounding the spray gun. Additonally, inadvertent discharge of electrically stored energy can create shock hazards to personnel who come in contact with the charging electrode, particularly when using hand-held spray guns.

To reduce the rate of discharge of capacitively stored energy in the foregoing situations to safe limits, it has been the practice in the prior art to connect one or more discrete resistors in the high voltage path which interconnects the charging electrode and the high voltage electrostatic supply. Usually, at least one relatively large resistor, and in some cases a second resistor of lesser value, are incorporated in the high voltage path within the spray gun upstream of the electrode. See, for example, U.S. Pat. Nos. 4,182,490 to Kennon; 4,335,851 to Hastings; and 3,599,038 to Skidmore.

One problem in the utilization of discrete resistors contained in prior art spray guns upstream of the electrode is that a mechanical joint or connection must be established between the high voltage cable and the resistor(s) within one or more passageways formed in the spray gun. Such connections are often metallic and are characterized by sharp edges giving rise to a corona discharge which can be transmitted through the gun wall to a grounded object. If the gun wall is insulated, repeated corona discharge causes dielectric breakdown of the insulation and the subsequent danger of a spark being transmitted through the gun wall to a grounded object.

The danger of corona discharge in prior art spray guns of this type has been reduced by injecting dielecric grease into the passageway(s) in the spray gun in an effort to encase the conductive metallic connection between the cable and resistor(s) with such dielectric grease. See U.S. Pat. Nos. 4,534,106 to Simashkevish et al and 4,543,710 to Hastings et al. While this reduces the risk of conrona discharge, it is often difficult for the user of the gun to ensure sufficient dielectric grease has been deposited into the passageway carrying the cable and resistor after these elements have been removed or replaced for routine maintenance. Many users do not have the facilities, or fail to take the time, to test the insulative properties of the spray gun after a resistor has been replaced. However, any air gaps in the area of the cable and resistor connection which are not filled with dielectric grease can cause corona discharge and this increases the hazard of ignition in the explosive environment surrounding the spray gun and/or a danger of shock to the operator.

Electrostatic spray guns, particularly those designed for spraying particulate powder material, also include a particle deflector mounted at the nozzle end of the spray gun. In one preferred form, the parricle deflector is in the shape of a cone which is mounted axially in the flow path of the particulate powder material sprayed from a discharge opening in the nozzle of the spray gun. The particles impact the cone and are deflected radially outwardly into a conical spray pattern for deposition onto an article to be coated. Structure may or may not be provided to adjust the axial position of the conical particle deflector with respect to the discharge opening of the nozzle of the gun. If adjustment is permitted, the width of the spray pattern can be varied for a given application. Examples of electrostatic powder spray guns employing adjustable deflectors are shown, for example, in U.S Pat. Nos. 3,521,815 to Szasz and 3,608,823 to Buschor.

It has been disclosed in co-pending U.S. patent applications, Ser. No. 724,392 entitled "Powder Spray Gun", filed Apr. 18, 1985 by Sharpless et al, and owned by the same assignee as this invention, and a continuation-in-part of that application, Ser. No. 791,352 filed Oct. 25, 1985 and entitled "Particle Spray Gun", that in order to maximize the "transfer efficiency", or the efficiency with which charged coating particles sprayed from the gun are deposited on an article to be coated, it is advantageous to form the particle deflector with a resistive sheet between its forward and rearward ends leaving exposed only the perimeter of the sheet at the periphery of the particle deflector. The resistive sheet is electrically connected to a high voltage electrostatic cable and its perimeter functions as a multi-point electrode which is positioned by the particle deflector proximate the discharge opening of the nozzle of the gun directly in the path of the particle stream. Other examples of electrostatic spray guns employing an electrode connected to or carried by a particle deflector include U.S. Pat. No. 3,521,815 to Szasz and U.K. Patent No. 1,406,358.

Although it is believed that the transfer efficiency is increased by the designs disclosed in the '392 and '352 applications, and perhaps by those disclosed in the '815 Szasz patent and '358 U.K. patent, ignition and shock hazards remain to some extent with each of these designs. The systems disclosed in the pending applications, and in the U.K. patent, each employ discrete resistors mechanically connected to an electrical cable upstream from the charging electrode within a passageway formed in the spray gun, which, for the reasons given above, can give rise to corona discharge resulting in an explosion or shock hazard. The spray gun disclosed in the Szasz patent apparently employs no resistors either in the gun or the cable which form the high voltage path between the charging electrode and electrostatic supply. This appears to present a serious problem of inadvertent rapid discharge of energy capacitively stored either in the components of the high voltage electrostatic supply, high voltage cable or the structure of the spray gun itself.

SUMMARY OF THE INVENTION

It is therefore among the objectives of this invention to provide an electrostatic spray device and cable assembly in which ignition and shock hazards are reduced while enhancing transfer efficiency, and in which variation of the shape of the spray pattern and electrostatic charge on the coating particles within the spray pattern emitted from the spray device is permitted.

These objectives are accomplished in an electrostatic spray device and cable assembly which in one preferred embodiment is axially movable within a dielectric sleeve carried within a main passageway formed in the spray device. The cable assembly comprises a dielectric tube having a hollow interior filled with dielectric grease which mounts a resistor and a portion of a high voltage electrostatic cable electrically connected to the resistor. A particle deflector having a charging electrode is mounted by the dielectric tube in the path of coating particles emitted from a powder flow passageway formed in the spray gun between the dielectric tube and main passageway toward an object to be coated, and the electrode is electrically connected to the cable. Adjustment means carried by the spray gun act upon the cable and dielectric tube to move them as a unit for adjusting the axial position of the deflector and electrode with respect to the discharge opening of the spray gun from which the coating particles are emitted so as to vary the shape of the spray pattern of coating particles and the electrostatic charge on such coating particles.

This construction is advantageous in that the sole mechanical connection between the high voltage cable and a resistor is made within the dielectric tube filled with dielectric grease to encase such connection. Additionally, the dielectric sleeve which carries the dielectric tube and cable provides further protection against corona discharge at the walls of the cable and protects the dielectric tube from contact with the particulate powder material flowing through the main passageway in the spray device which could otherwise abrade a hole in the dielectric tube.

More specifically, a portion of the high voltage cable is fixedly mounted within the hollow interior of the dielectric tube which in one preferred embodiment is axially movable within a cable sleeve mounted within a passageway formed in the spray gun. One end of the cable is electrically connected to the resistor within the dielectric tube, and the dielectric grease encases the cable, resistor and the conductive metallic connection therebetween. The tube is open at each end to permit removal of the cable from one end and the resistor from the opposite end in the event of failure of the resistor or for routine maintenance. Upon replacement of the cable and a resistor back into the tube, new dielectric grease is filled around the resistor and its connection to the cable to eliminate any air bubbles within the tube.

The resistor is provided with a female connector which extends outwardly from the dielectric tube and is adapted to connect to a male connector carried by a particle deflector. In one preferred embodiment, an electrode in the form of a resistive sheet of mesh material is sandwiched between two dielectric halves of the particle deflector and is electrically connected to the male connector carried by the particle deflector. The particle deflector and electrode are mounted axially in the path of the powder material ejected from the nozzle of the spray gun. The particulate powder material impacts the rearward surface of the particle deflector forming a conical-shaped spray pattern upon the article to be coated, and also obtains an electrostatic charge from the periphery of the resistive sheet charging electrode so that the powder material adhers to the object to be coated.

A high voltage cable of the type disclosed in U.S. Pat. No. 4,576,827 is preferably employed, which provides a resistive high voltage transmission path for transmitting high voltage between a supply of electrostatic potential and the electrode. Alternatively, a high voltage cable employing discrete, spaced resistors may be employed which is connected between the high voltage electrostatic supply and the charging electrode.

In a presently preferred embodiment, cable adjustment structure carried by the spray gun provides for axial adjustment of the cable and dielectric tube to vary the position of the charging electrode and particle deflector with respect to the discharge opening in the nozzle of the spray gun. This cable adjustment structure comprises a nut fixed to the gun body which is formed with an internally threaded bore. The fixed nut receives an adjustment member formed with a throughbore, an extension at the forward end and an external surface which is at least partially threaded. The external threads of the adjustment member mate with the internal threads of the fixed nut to permit axial movement of the adjustment member relative to the fixed nut upon rotation of the adjustment member.

The high voltage cable extends, through the throughbore of the adjustment member and into the dielectric tube located within a passageway formed in the barrel of the spray gun. An adaptor is fixedly mounted to the cable by a cable mount, and a clamp connects the adaptor to the dielectric tube. The adaptor includes a seat formed by a shoulder and retaining ring which rotatably receives the extension of the adjustment member to permit rotation of the adjustment member with respect to the adaptor.

In order to axially move the cable with respect to the spray gun, a lock nut threaded onto the exterior surface of the adjustment member is rotated out of contact with the fixed nut. The adjustment member is then rotated so that it moves axially relative to the fixed nut and rotates with respect to the cable and adaptor. While the adaptor permits rotation of the adjustment member relative thereto, axial movement of the adjustment member is transmitted by the adaptor to the cable and dielectric tube by virtue of the connection between the extension in the adjustment member and the seat formed in the adaptor. The high voltage cable and dielectric tube move as a unit, which, in turn moves the charging electrode and deflector axially relative to the spray gun in either a forward or rearward direction depending upon the direction of rotation of the adjustment member.

Axial adjustment of the particle deflector and electrode is an advantageous feature of the spray gun herein. Adjustment of the axial position of the particle deflector permits variation of the spray pattern of the coating particles emitted from the nozzle of the spray gun. Additionally, movement of the deflector varies the position between the electrode carried by the deflector and a corona shield mounted at the forward end of the spray gun concentric to the discharge opening of the powder flow passageway. Variation in the position of the electrode permits better concentration of the electrostatic field created by the electrode to improve transfer efficiency.

Furthermore, axial adjustment of the position of the electrode relative to the discharge orifice of the nozzle can avoid a concentration of coating material at the center of the pattern while providing an acceptable margin of safety against corona discharge. For example, as the axial distance of the electrode relative to the nozzle increases, the coating particles at the center of the pattern tend to receive a higher electrostatic charge which results in a somewhat greater concentration of coating particles at the center of the pattern on the article to be coated. This problem is reduced by moving the electrode axially closer to the discharge opening of the nozzle. On the other hand, if the charging electrode extends too close to the discharge opening of the nozzle, there may be little or no opportunity for the electrostatic charge it carries to bleed off before coming into contact with a grounded object. In this instance, it is desirable to move the charging electrode axially outwardly from the nozzle so that it is exposed to such an extend that when a grounded object approaches the spray gun the electrode gradually discharges. This avoids producing a spark having sufficient energy to ignite the explosive environment surrounding the spray gun.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
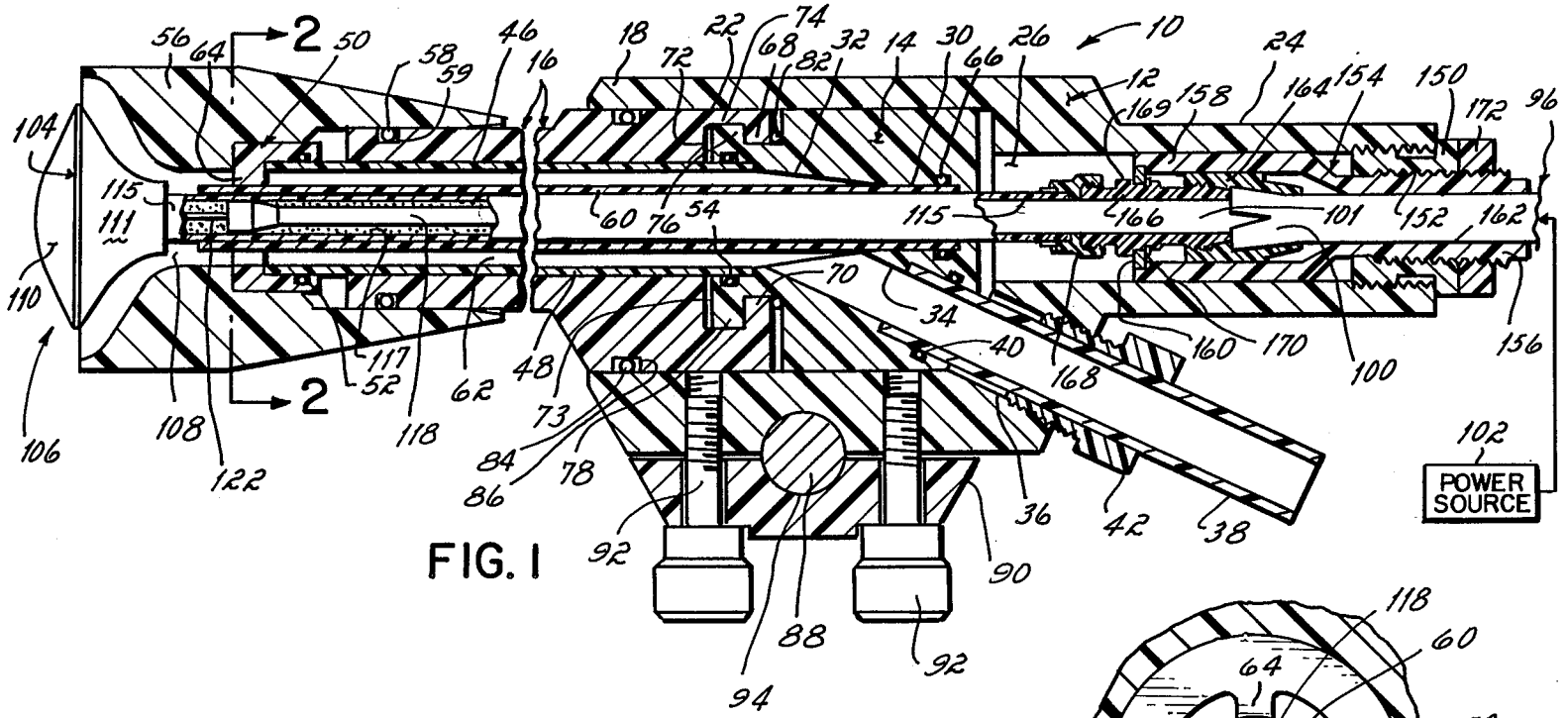
FIG. 1 is a cross sectional view in partial elevation of a preferred embodiment of the electrostatic spray gun.
Figure 2:
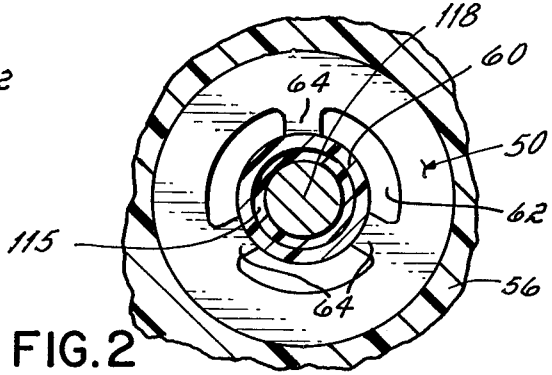
FIG. 2 is a cross sectional view of the barrel portion of the spray gun taken generally along line 2—2 of FIG. 1.

Referring now to FIGS. 1 and 2, the electrostatic spray gun 10 comprises a gun body 12, a powder inlet body 14, and a barrel 16 which are interconnected in the manner described in detail below. The spray gun 10 is adapted to emit coating particles either in solid particulate form toward an article to be coated (not shown), and impart an electrostatic charge to such particles to obtain efficient and uniform coverage of the article.

The gun body 12 comprises a forward portion 18 having a cylindrical-shaped, hollow interior forming a cylindrical wall 22. The forward portion 18 of the gun body 12 is stepped radially inwardly from front to rear forming a rearward portion 24 of smaller diameter having a throughbore 26. For purposes of the present discussion, the term "forward" refers to the direction toward the front of the gun where coating particles are emitted and "rearward" refers to the opposite end of the gun.

The powder inlet body 14 is formed with a through bore 30 having a radially outwardly tapered portion 32 at the forward end thereof. A bore 34 is formed in the powder inlet body 14 at an acute angle with respect to the throughbore 30 which extends between the tapered portion 32 of throughbore 30 and the rearward end of the powder inlet body 14.

With the powder inlet body 14 in position within the hollow interior of gun body 12, the bore 34 of powder inlet body 14 aligns with a bore 36 formed in the gun body 12. The bores 34, 36 receive a section of rigid tubing 38, preferably formed of a dielectric material, which is sealed within the bore 34 of powder inlet body 14 by an O-ring 40. The tubing 38 is fixed in place within the gun body 12 and powder inlet body 14 by a tube retainer 42 having external threads which mate with internal threads formed along the wall defined by the bore 36 in gun body 12. The tubing 38 is adapted to convey particulate powder material from a source (not shown) to the tapered portion 32 of the throughbore 30 in powder inlet body 14.

The barrel 16 is formed with a main, central throughbore or passageway which defines a cylindrical wall 46. The interior surface of the cylindrical wall 46 is lined with a barrel liner 48, preferably formed of dielectric material, having a forward end which supports a cable liner support 50 and a rearward end which extends into the forward end of the powder inlet body 14. The barrel liner 48 is sealed at its forward end to the cable liner support 50 by an O-ring 52, and at its rearward end to the powder inlet body 14 by an O-ring 54. The forward end of barrel 16 mounts a corona shield 56 which is retained thereto by frictional engagement with the exterior of barrel 16 and by the O-ring 58 carried with a seat 59 formed in the barrel 16.

Figure 4:
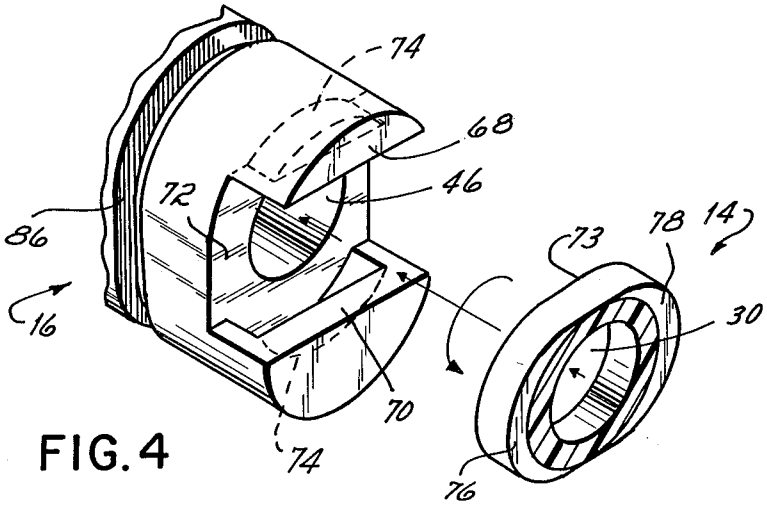
FIG. 4 is a disassembled, diagrammatic perspective view of the bayonet connection between portions of the spray gun herein.

Referring now to FIGS. 1 and 4, the structure for interconnecting the gun body 12, powder inlet body 14 and barrel 16 is illustrated. The rearward end of barrel 16 is formed with a pair of opposed flanges 68, 70 which extend rearwardly from the rear face 72 of barrel 16. The flanges 68, 70 are spaced approximately 180° apart and each are formed with a concave-shaped seat 74.

The forward end of powder inlet body 14 is formed in an oval shape defining a pair of opposed side edges 76, 78 spaced approximately 180°.from one another. The barrel liner 48 is illustrated within the barrel 16 in FIG. 4 for clarity of the drawing.

In order to assemble the powder inlet body 14 and barrel 16, the barrel 16 is positioned relative to the powder inlet body 14 so that the side edges 76, 78 of the powder inlet body 14 are spaced about 90° from the flanges 68,70 in the barrel 16. The rear face 72 of barrel 16 is brought into contact with the end face 73 of body 14, and the barrel 16 is then rotated 90° with respect to the powder inlet body 14 so that the side edges 76, 78 of barrel 16 are received within the seats 74 of the barrel 16. Preferably, a compressible O-ring 82 is interposed between the flanges 68,70 and inlet body 14 to tightly secure the barrel 16 against the powder inlet body 14.

The forward portion 18 of the gun body 12 is then fitted over the outer surfaces of the assembled powder inlet body 14 and barrel 16. A friction fit is formed between the gun body 12, and powder inlet body 14 and barrel 16, which is assisted by an O-ring 84 mounted in a seat 86 formed in the barrel 16. The O-ring 84 is compressed by the cylindrical wall 22 of gun body 12 and helps retain the gun body 12 in position on the barrel 16 and powder inlet body 14.

In the presently preferred embodiment, the spray gun 10 is mounted in stationary position upon a support bar 88. The structure for mounting the spray gun 10 to support bar 88 includes a clamp 90 which is mounted by screws 92 to the bottom surface of gun body 12. Both the clamp 90 and gun body 12 are formed with slots which align to form a bore 94 for receiving the support bar 88. Alternatively, it is contemplated that the spray gun 10 could be designed with a handle (not shown) for the manual application of coating particles onto an article to be coated.

In one presently preferred embodiment, once the gun body 12, powder inlet body 14 and barrel 16 are assembled as described above, and mounted to the support bar 88, a cable sleeve 60, preferably in the form of a rigid tube of plastic or other dielectric material, is inserted within the main passageway of barrel 16 forming a space 62 between it and the barrel liner 48. The forward end of the cable sleeve 60 is carried by the cable liner support 50 which has three radially inwardly extending projections or lands 64 spaced approximately 120° apart in contact with the cable sleeve 60. See FIG. 1. The rearward end of the cable sleeve 60 is received within the throughbore 30 formed in the powder inlet body 14 and sealed thereto by an O-ring 66.

The cable sleeve 60 receives and supports a cable assembly which comprises a high voltage cable 96 mounted within the hollow interior of a dielectric tube 115 as described in detail below. In a presently preferred embodiment, the cable 96 is of a type described in U.S. Pat. No. 4,576,827 to Hastings et al, which is incorporated by reference in its entirety herein. A cable of the type constructed in accordance with the teachings of the '827 Hastings et al patent comprises a high voltage insulative sheath 100 which encases continuous silicon carbide fibers combined to form a yarn core 101. Alternatively, the cable 96 could be constructed in accordance with the teachings of U.S. Pat. No. 4,103,276 which is also incorporated by reference in its entirety herein. Cables of the type disclosed in U.S. Pat. No. 4,103,276 include a plurality of discrete resistors serially connected at intervals along the length of the cable.

As described below, the high voltage cable 98 is interconnected between a high voltage electrostatic supply 102 and a charging electrode 104 carried by a particle deflector 106 which is positioned at the forward end of the spray gun 10. The space 62 between the cable sleeve 60 and barrel liner 48 provides a path along which coating particles flow from the powder tubing 38 to a discharge opening 108 at the forward end of the barrel 16. The charging electrode 104 is positioned in charging relationship to the coating particles emitted from the discharge opening 108 so that an electrostatic charge is imparted to the coating particles for deposition upon an article to be coated.

Figure 3:
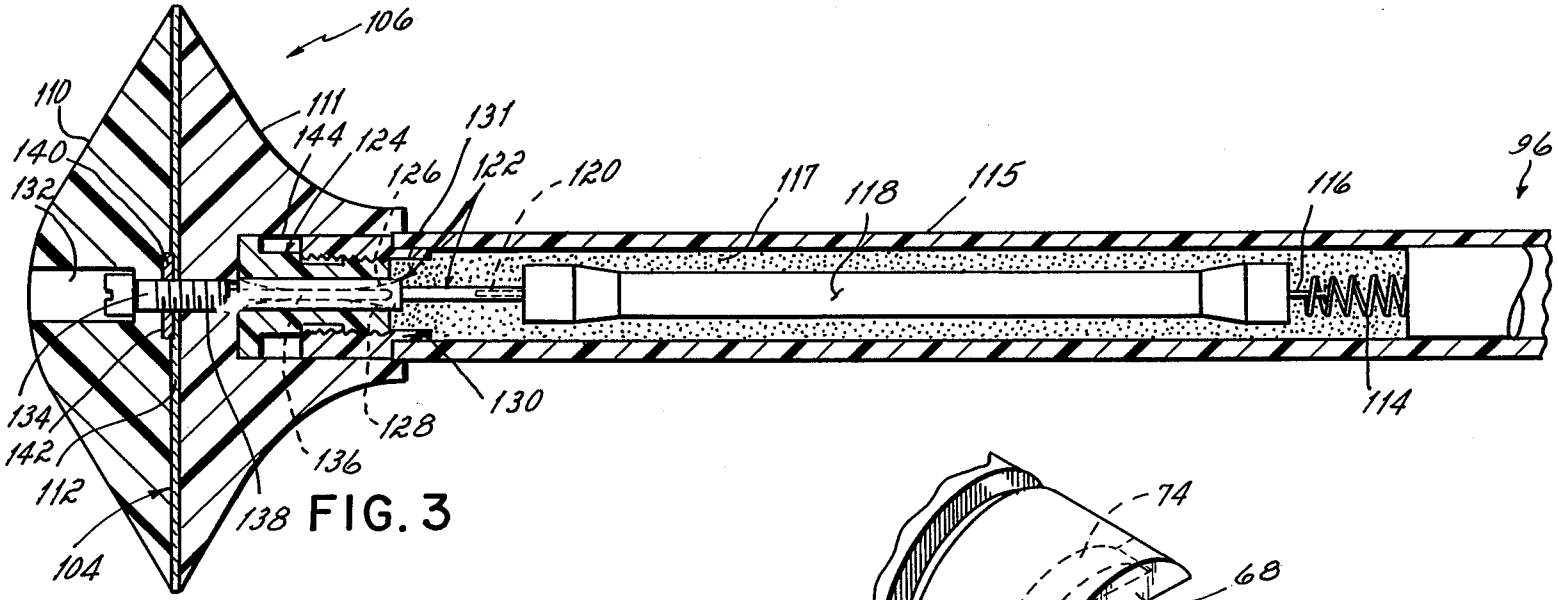
FIG. 3 is an enlarged, cross sectional view of the forward portion of the cable assembly illustrating the electrical connection to the electrode as used in the spray gun shown in FIG. 1.

In a presently preferred embodiment illustrated in FIG. 3, the particle deflector 106 is of the type disclosed in U.S. patent application Ser. No. 791,352, filed Oct. 25, 1985 and entitled "Particle Spray Gun", both of which are incorporated by reference in their entirety herein. In accordance with the disclosure of these applications, the particle deflector 106 is formed of dielectric material with a forward half section 110 and a generally conically shaped, rearward half section 111 having a cavity defining a cylindrical wall 144. The half sections 110, 111 are interconnected and mounted directly in the path of the coating particles emitted from the discharge opening 108 in the barrel 16, as described below. The coating particle stream impinges against the rearwardly facing surface of the rearward half section 111 which directs the particles radially outwardly forming a conical-shaped pattern upon the article to be coated.

A plurality of electrode elements, preferably in the form of a resistive fiber disc 112 are sandwiched between the forward and rearward half sections 110, 111 of particle deflector 106 so that at least a portion of the electrode elements are located at the periphery of the particle deflector 106 for direct exposure to the coating particles emitted from the discharge opening 108. As described below, the high voltage cable 96 is electrically connected to the electrode disc 112 within particle deflector 106 to electrostatically energize the electrode disc 112 and produce a corona discharge in the path of the coating particles emitted from the gun barrel 16.

Referring now to FIG. 3, the cable assembly of this invention is formed by stripping the forward end of the sheath 100 of cable 96 to expose its core 101 which is inserted within the hollow interior of the dielectric tube 115, which is filled with dielectric grease 117. The cable core 101 electrically contacts a spring 114 soldered to a lead 116 on one end of a resistor 118, which is also carried within the hollow interior of tube 115. The lead 120 on the opposite end of resistor 118 is soldered to a tubular pin 122, which, in turn, is supported within a plastic socket 124. The forward end of pin 122 is formed with an internal bore within which a pair of opposed leaf springs 126, 128 are fixedly mounted and hence in electrical contact with the tubular pin 122. A portion of the external surface of the plastic socket 124 is threaded to mate with internal threads formed in a plastic nut 130 which is fixedly mounted within the forward end of the cable well or tube 115. Preferably, the resistor 118, leads 116, 120, spring 114 and cable core 101 are all covered with the dielectric grease 117 which fills the tube 115.

In a presently preferred embodiment, the plastic nut 130 is formed with a throughbore 131 at its rearward end which is slightly larger than the diameter of the resistor 118 so that the resistor 118 can be pulled out of the tube 115 through the plastic nut 130. In the event of a failure of the resistor 118, maintenance is performed by first threading the plastic socket 124 out of the plastic nut 130. The resistor 118 is then pulled out of the forward end of the tube 115 by grasping pin 122 connected thereto. The cable 96 is removed from the rearward end of the tube 115 during such maintenance. A new resistor 118 and the cable 96 are then inserted into the tube 115, from its forward and rearward ends respectively, and dielectric grease is injected into the tube 115 to surround the resistor 118, its connection to cable 96 via spring 114 and a portion of the pin 122. A syringe-type device such as disclosed in U.S. Pat. No. 4,534,106 may be used to fill the tube 115 with dielecric grease to eliminate any air bubbles therein.

The pin 122 with leaf springs 126, 128 forms a female conmnector which is adapted to receive and mount to a male connector formed in the particle deflector 106. As shown on the lefthand side of FIG. 3, the forward half section 110 of deflector 106 is formed with a stepped bore 132 which receives a screw 134 having a stud 136 press fitted in its stem portion. The screw 134 is threaded into a bore 138 formed in the rearward half section 111 of deflector 106 to connect the half sections 110, 111 together. A metal washer 140 is carried in a seat 142 formed in the forward half section 110 at its interface with the electrode disc 112 which is forced against the electrode disc 112 upon tightening of screw 134. This creates a good electrical connection between the electrode disc 112, screw 134 and the stud 136 mounted in the screw 134.

In order to connect the cable 96 with the electrode disc 112 and deflector 106, in one preferred embodiment the cable 96 and tube 115 are inserted as a unit within the cable sleeve 60 and moved axially forwardly until the socket 124 and nut 130 are exposed at the forward end of the barrel 16. The deflector 106 is then placed over the socket 124 and nut 130 which are enclosed by the cylindrical wall 144 formed by the cavity in the rearward half section 111 of the deflector 106. The stud 136 enters the internal cavity of pin 122 as the deflector 106 is moved into position and seats between the opposed leaf springs 126, 128. This completes the electrical path between the cable 96 and electrode disc 112. The mechanical connection between the cable 96 and resistor 118, and between the stud 136 and pin 12, are thus made inside of the cable sleeve 60 and particle deflector 106, respectively. The cable sleeve 60 and particle deflector 106 are each formed of dielectric material to reduce the risk of corona discharge through the barrel 16 or any other portion of the spray gun 10.

Referring now to the righthand portion of FIG. 1, cable adjustment structure is illustrated which permits adjustment of the axial position of the cable 96 and tube 115 within the cable sleeve 60 so as to vary the position of the particle deflector 106 and electrode 112 relative to the discharge opening 108 in barrel 16. The cable adjustment structure comprises a fixed nut 150 mounted at the rearward portion 24 of gun body 12 which is formed with an internally threaded bore 152. A cable adjustor 154 has an externally threaded rearward end 156 which is received within the internally threaded bore 152 of fixed nut 150, and a forward end 158 of larger diameter having a radially inwardly extending annular ring 160. The rearward end 156 of cable adjustor 154 is formed with a throughbore 162 which increases in diameter at its forward end 158. The high voltage cable 96 is inserted through the cable adjustor 154 and its sheath 100 is removed so that only the core 101 of the cable 96 extends from the cable adjustor 154. As stated above, the core 101 is received within well or tube 115 which are inserted as a unit through the cable sleeve 60 of the barrel 16.

A nut 164 is mounted to the end of sheath 100 at the location where the sheath 100 was removed to expose the core 101. The nut 164 threadedly engages one end of a cable adaptor 166 to fixedly mount the cable adaptor 166 to the cable core 101 and cable 96. The opposite end of the cable adaptor 166 is threaded into a clamping nut 168 which is secured to the tube 115 by a compression ferrule-type joint (not shown), for example. The cable 96 and cable well or tube 115 are therefore fixed together through the cable adaptor 166 and movable as a unit within the barrel liner 60. The cable adaptor 166 is preferably formed with a radially outwardly extending shoulder 169 near its forward end. The annular ring 160 at the forward end 158 of cable adjustor 14 rests against the shoulder 169 of cable adaptor 166 and is retained in place thereon by a retaining ring 170.

The cable adjustment structure operates as follows. In order to move the cable 96 forwardly, for example, a lock nut 172, movable axially along the externally threaded surface of cable adjustor 154, is rotated out of engagement with the rearward surface of the fixed nut 150. The cable adjustor 154 is then rotated in one direction so that it moves axially with respect to the fixed nut 150. The cable adjustor 154 is slidable in rotation with respect to the cable 96, nut 164, cable adaptor 166, and bore 26 of gun body 12. Thus an axial movement of cable adjustor 154 is transmitted to the cable 96 via the connection between the annular ring 160 of cable adjustor 154 and the shoulder 169 and retaining 170 of the cable adaptor 166. The shoulder 169 and retaining ring 170 of cable adaptor 166 permit rotation of cable adjustor 154 but provide for axial movement of the cable adaptor 166, and, in turn, the cable 96 and cable well or tube 115, with the cable adjustor 154. Movement of the cable 96 and cable well or tube 115 in the opposite direction is obtained by rotating the cable adjustor 154 in an opposite direction. The cable adjustor 154 is locked in place to maintain the cable 96 in a fixed position by tightening the lock nut 172 against the fixed nut 150.

Axial movement of the cable 96 and cable well or tube 115 results in movement of the particle deflector 106 relative to the discharge opening 108 at the forward end of the spray gun 10 due to the connection between the cable well or tube 115 and particle deflector 106 as described above. Such axial movement varies the size and geometry of the discharge opening 108 to vary the spray pattern of the coating particles and also varies the concentration of the electrostatic field through which the coating particles pass on their way to the object which is to be coated.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, although the Figures. illustrate a combined particle deflector and electrode connected to the high voltage cable, it is contemplated that an electrode without a particle deflector could be directly mounted to the cable for imparting an electrostatic charge to particulate powder material.

Therefore, it is intended that the invention not be limited to the particular embodiment disclosed as the best mode contemplated for carrying out this invention, but that the invention will include all embodiments falling within the scope of the appended claims.

We claim:

1. An electrostatic spray coating apparatus for spraying solid particulate powder material onto an article, comprising:

a spray device formed with a powder flow passage and a discharge opening at one end of said passage for emitting particulate powder material toward an article to be coated;

a cable assembly contained within said powder flow passage in said spray device, said cable assembly including a dielectric tube having a hollow interior filled in part with a flowable dielectric material, and a high voltage electrostatic cable fixedly secured within said hollow interior of said dielectric tube;

a resistor mounted within said hollow interior of said dielectric tube, said resistor having one lead electrically connected to said high voltage electrostatic cable;

first connector means mounted to said dielectric tube, said first connector means being electrically connected to another lead of said resistor;

a particle deflector carrying an electrode, said particle deflector being mounted on said dielectric tube in the path of coating particles emitted from said discharge opening of said spray device;

second connector means mounted to said particle deflector in electrical contact with said electrode carried by said particle deflector, said second connector means being connectable with said first connector means to form an electrical flow path between said high voltage electrostatic cable and said electrode.

2. The apparatus of claim 1 in which said first connector means comprises:

a pin electrically connected to said resistor, said pin having a throughbore which receives a pair of opposed leaf springs;

a nut mounted to said dielectric tube, said nut being formed with a passageway defining a wall having internal threads;

a socket having external threads which mate with said internal threads of said nut, said socket being formed with a throughbore adapted to mount said pin.

3. The apparatus of claim 2 in which said particle deflector comprises a forward half section and a rearward half section formed with an opening, said electrode is a resistive sheet sandwiched between said forward and rearward half sections, said second connector means comprising:

a screw interconnecting said forward half section and said rearward half section of said particle deflector;

a washer tightened by said screw against said electrode for ensuring electrical contact between said electrode and said screw;

a stud mounted to said screw and extending into said opening formed in said rearward half section of said particle deflector;

said particle deflector being mounted to said spray device so that said socket and nut of said first connector means extend into said opening in said rearward half section of said particle deflector, and said stud mounted to said screw extends into said throughbore of said pin and in electrical contact with said opposed leaf springs therein.

4. An electrostatic spray coating apparatus for spraying solid particulate powder coating particles onto an article, comprising:

a spray device formed with a powder flow passageway and a discharge opening for emitting coating particles toward an article to be coated;

a cable assembly insertable within said passageway in said spray device, said cable assembly including a tube having a hollow interior filled with dielectric grease and a high voltage electrostatic cable fixedly secured within said hollow interior of said tube;

a particle deflector having an electrode connected to said cable, said particle deflector and electrode being mounted on said tube in the path of coating particles emitted from said discharge opening of said spray device;

adjustment means for axially moving said cable assembly within said passageway so that said particle deflector and electrode are moved relative to said discharge opening of said spray device in response to said axial movement of said cable assembly, said adjustment means comprising:

(i) a fixed member mounted to said spray device, said fixed member having a threaded internal passageway;

(ii) an adjustment member having an internal bore adapted to rotatably receive said high voltage electrostatic cable, said adjustment member being formed with external threads which mate with said internal threads in said internal passageway of said fixed member to permit axial movement of said adjustment member relative to said fixed member upon rotation of said adjustment member;

(iii) a cable mount fixed to said high voltage electrostatic cable;

(iv) a spacer interconnecting said adjustment member and said cable mount, said cable mount having means for retaining said spacer in a fixed axial position relative thereto while permitting rotation of said spacer relative to said cable mount; and (v) a clamp interconnecting said cable mount and said tube.

5. An electrostatic spray coating apparatus, comprising:

a spray device formed with a powder flow passageway and a discharge opening for emitting powder coating particles toward an article to be coated;

a dielectric sleeve contained at least in part within said passageway, said discharge opening surrounding said dielectric sleeve;

a cable assembly insertable within said dielectric sleeve in said spray device, said cable assembly including a dielectric tube having a hollow interior filled with dielectric grease and a high voltage electrostatic cable fixedly secured within said hollow interior of said dielectric tube;

an electrode mounted to said dielectric tube in electrical contact with said cable and in charging relationship to coating particles emitted from said particle discharge opening of said spray device;

adjustment means for axially moving said cable assembly within said passageway so that said electrode is moved relative to said discharge opening of said spray device in response to said axial movment of said cable assembly, said adjustment means comprising:

(i) a fixed member mounted to said spray device, said fixed member having a threaded internal passageway;

(ii) an adjustment member having an internal bore adapted to rotatably receive said high voltage electrostatic cable, said adjustment member being formed with external threads which mate with said internal threads in said internal passageway of said fixed member to permit axial movement of said adjustment member relative to said fixed member upon rotation of said adjustment member;

(iii) a cable mount fixed to said high voltage electrostatic cable;

(iv) a spacer interconnecting said adjustment member and said cable mount, said cable mount having means for retaining said spacer in a fixed axial position relative thereto while permitting rotation of said spacer relative to said cable mount; and (v) a clamp interconnecting said cable mount and said tube which carries a portion of said high voltage electrostatic cable.

* * * * *

UNITED STATES PATENT AND TRADEMARK OFFICE

CERTIFICATE OF CORRECTION

PATENT NO. : 4,784,331

DATED : November 15, 1988

INVENTOR(S) : John Sharpless et al

It is certified that error appears in the above-identified patent and that said Letters Patent is hereby corrected as shown below:

In column 1, line 41, "supplied" should be --supplies--.

In column 1, line 51, "elecrode" should be --electrode--.

In column 2, line 18, "dielecric" should be --dielectric--.

In column 2, line 41, "parricle" should be --particle--.

In column 4, line 33, "adhers" should be --adheres--.

In column 5, line 50, "extend" should be --extent--.

In column 7, line 48, "Fig. 1" should be --Fig. 2--.

In column 8, line 3, "cable 98" should be --cable 96--.

In column 8, line 19, after ""Particle Spray Gun",", insert --and U.S. Patent Application Serial No. 724,392, filed April 18, 1985 and entitled "Powder Spray Gun",--.

In column 9, line 14, "dielecric" should be --dielectric--.

In column 9, line 17, "conmnector" should be --connector--.

In column 9, line 46, "pin 12" should be --pin 122--.

UNITED STATES PATENT AND TRADEMARK OFFICE

CERTIFICATE OF CORRECTION

PATENT NO. : 4,784,331

DATED : November 15, 1988

INVENTOR(S) : John Sharpless et al

It is certified that error appears in the above-identified patent and that said Letters Patent is hereby corrected as shown below:

In column 10, line 19, "adjustor 14" should be --adjustor 154--.

In column 10, line 34, after "retaining", insert --ring--.

Signed and Sealed this

Fifteenth Day of August, 1989

*Attest:*

DONALD J. QUIGG

*Attesting Officer*

*Commissioner of Patents and Trademarks*